United States Patent [19]

Wagdy

[11] Patent Number: 4,483,473

[45] Date of Patent: Nov. 20, 1984

[54] PORTABLE GAS-POWERED FASTENER DRIVING TOOL

[75] Inventor: Mohamed K. Wagdy, Des Plaines, Ill.

[73] Assignee: Signode Corporation, Glenview, Ill.

[21] Appl. No.: 490,408

[22] Filed: May 2, 1983

[51] Int. Cl.[3] ..... B25C 1/04; B25C 1/08

[52] U.S. Cl. ..... 227/8; 123/46 SC; 227/10

[58] Field of Search ..... 60/632, 633; 123/46 SC, 123/48 A; 173/121, 134, 139; 222/8, 9, 10, 11, 130

[56] References Cited

U.S. PATENT DOCUMENTS

| | | | |
|---|---|---|---|
| 3,012,549 | 12/1961 | Bard et al. | 173/134 |
| 3,042,008 | 7/1962 | Liesse | 123/46 SC |
| 3,381,672 | 5/1968 | Tobias et al. | 227/10 X |
| 3,576,103 | 4/1971 | Kahn | 227/10 X |
| 3,584,695 | 6/1971 | Turnbull | 227/10 X |
| 3,850,359 | 11/1974 | Obergfell | 227/10 |
| 3,967,771 | 7/1976 | Smith | 227/10 |
| 4,075,850 | 2/1978 | Nakazato et al. | 227/10 |
| 4,200,213 | 4/1980 | Liesse | 227/10 |
| 4,218,888 | 8/1980 | Jayne | 60/632 |
| 4,377,991 | 3/1983 | Liesse | 60/633 X |

*Primary Examiner*—Paul A. Bell

*Attorney, Agent, or Firm*—Dressler, Goldsmith, Shore, Sutker & Milnamow, Ltd.

[57] ABSTRACT

A portable gas-fired fastener driving tool in which the tool cannot be operated until the combustion chamber is closed and the combustion chamber cannot be reopened after ignition until the trigger is released. The operation of the trigger is permitted by the actuation of a bottom trip mechanism which controls the movement of a sleeve mechanism that regulates the opening and closing of the combustion chamber. During the driving action, the combustion gases above the piston are evacuated through valved openings in the cylinder adjacent the bottom thereof. The piston contacts a bumper at the bottom of its travel and the difference between the vacuum in the combustion chamber and atmospheric air acts to return the piston to its driving position.

4 Claims, 7 Drawing Figures

FIG. 2
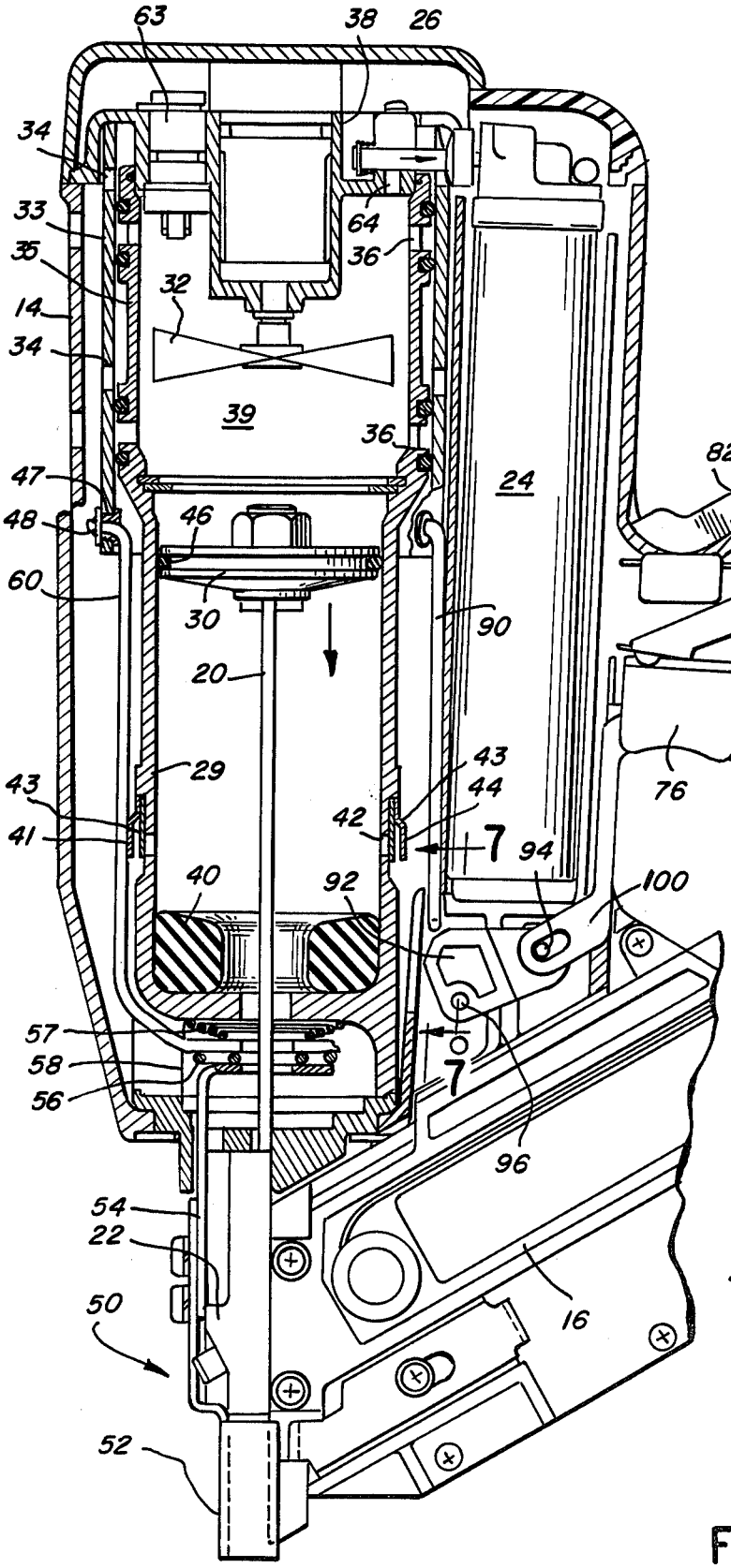
FIG. 7
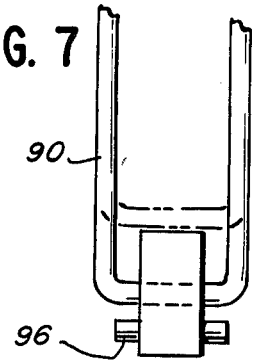
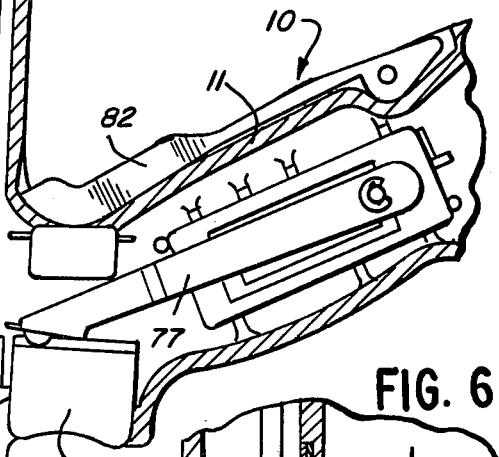
FIG. 6
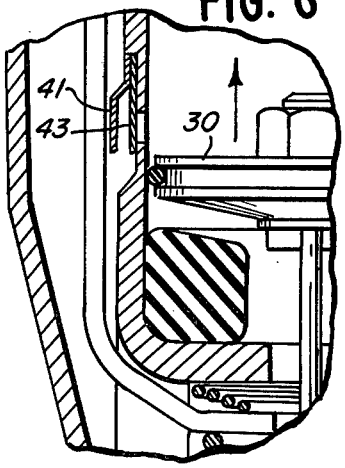
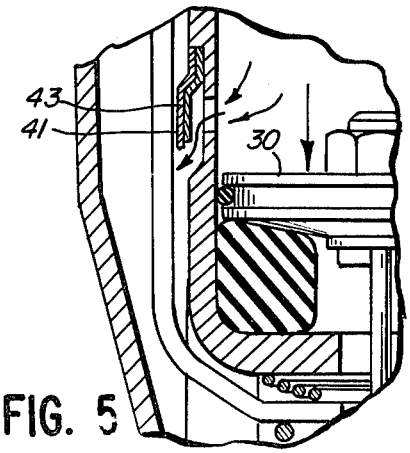
FIG. 5

PORTABLE GAS-POWERED FASTENER DRIVING TOOL

TECHNICAL FIELD

This invention relates generally to fastener driving tools of the type used to drive staples, nails, etc. into a workpiece and in particular to such a tool powered by the forces generated in a combustion chamber.

BACKGROUND OF THE INVENTION

There is a need to have a portable tool capable of generating high forces to drive fasteners such as a 3½ inch long nail. The current prevalent tool for driving such fasteners requires a continuous source of pressurized air. There have been attempts at developing portable tools using internal combustion principles such as those illustrated in Liesse U.S. Pat. Nos. 3,042,008 and 4,200,213 and Smith U.S. Pat. No. 3,967,771. In addition to those patents it is to be noted that the assignee of the present invention has made a significant development in this area as covered by two pending patent applications filed Jan. 22, 1981 in the name of M. Nikolich entitled "Combustion Gas Powered Fastener Driving Tool", Ser. No. 227,194 now U.S. Pat. No. 4,403,722 and "Portable Gas-Powered Tool With Linear Motor", Ser. No. 227,193 both of which are assigned to the assignee of the present invention. The tools shown in these applications will be referred to herein since a number of the features covered in the instant application are improvements over such tools.

It is to be noted that some of the basic concepts employed in the tools illustrated in the aforementioned Nikolich applications are incorporated in the tools illustrated herein. While sufficient details will be set forth herein for an understanding of the present invention, if further information is desired reference may be made to such applications which are incorporated herein by reference. It is to be noted that the tools disclosed in the aforementioned Nikolich applications are believed to be totally satisfactory and that as in all such developments improvements are continuously being made to increase the efficiency and operability of such tools and it is in these areas that the instant application is directed.

SUMMARY OF THE INVENTION

The present invention relates to an improved fastener driving tool powered by the gases produced from the combustion of a fuel and air mixture within a confined space. The instant tool contains a number of novel features which adds to the efficiency of the tool by way of providing a novel mechanism for controlling the opening and closing of the combination chamber in conjunction with the bottom trip mechanism which prevents inadvertant operation of the tool unless it is in engagement with the workpiece. This is accomplished by providing a sleeve valve that is controlled by the operation of the bottom trip mechanism, which sleeve valve acts to open or close the combustion chamber ports through which air is introduced and spent combustion gasses are scavenged. During the operation of the tool the spent combustion gases are allowed to escape through a check valve located in the side wall of the piston cylinder adjacent a bumper located at the bottom of the cylinder in which the drive piston is located. A partial vacuum is momentarily maintained in the combustion chamber to permit atmospheric air disposed below the driven piston to positively return the piston to its driving position In addition there is provided a novel metering valve arrangement operated by the valve sleeve and an interlock mechanism which prevents actuation of the fan in the combustion chamber in the event the magazine is inadvertently disconnected.

Essentially, when a fastener is to be driven the combustion chamber is closed off by the movement of a slidable sleeve through the action of a work sensitive probe member that is engaged when the tool is moved into contact with the workpiece into which the fastener is to be driven. The closing of the chamber by the slidable sleeve also acts to introduce fuel into the combusion chamber. Movement of the slidable sleeve to close the combustion chamber permits the trigger to be moved to operate the tool. Pulling of the trigger acts to generate a spark in the combustion chamber and prior thereto the fan in the combustion chamber is turned on. This sequence of events occurs substantially simultaneously with the result that combustion occurs and the force generated moves the piston to drive a fastener into a workpiece.

Shortly before the piston reaches the bottom of its driving stroke where it contacts a resilient bumper the piston passes valved ports in the piston cylinder wall above the bottom of the piston cylinder to exhaust gases from the combustion chamber. These ports help facilitate removal of the combustion gases to aid in the partial vacuum being set up so that atmospheric air beneath the piston after passing the cylinder ports is more effective to return the piston to its driving position. The above actions take place very quickly and thereafter when the trigger is released and the tool is removed from the workpiece the combustion chamber is opened to bring about further expunging of the spent gases from the chamber and fresh air is admitted for a subsequent cycle. A trigger interlock mechanism includes a cam arrangement which serves to retain the slidable cylinder in the closed position until the trigger is released. When the trigger is released the slidable valve sleeve is returned to open the combustion chamber ports by the action of a compression spring that acts to move the work sensitive probe assembly outwardly relative to the nose of the tool in which position it will prevent subsequent actuation of the tool until the workpiece is again contacted.

In the following description of the drawings the features unique to the improved tool are disclosed and will be described in detail and general reference will be made to other components of the tool to understand the operation thereof. For further details of a similar tool reference is again made to the Nikolich applications Ser. Nos. 227,193 and 227,194 filed Jan. 22, 1981.

BRIEF DESCRIPTION OF THE DRAWINGS

FIG. 2 is a view similar to FIG. 1 but with the tool in contact with the workpiece and illustrating the piston in both the driving and driven positions;

FIG. 5 is a partial enlarged view showing the piston in its driven position; and FIG. 6 is a view similar to FIG. 5 with the pistion returning to its driving position; and FIG. 7 is a view taken along line 7—7 of FIG. 2.

DETAILED DESCRIPTION

Figure 1:
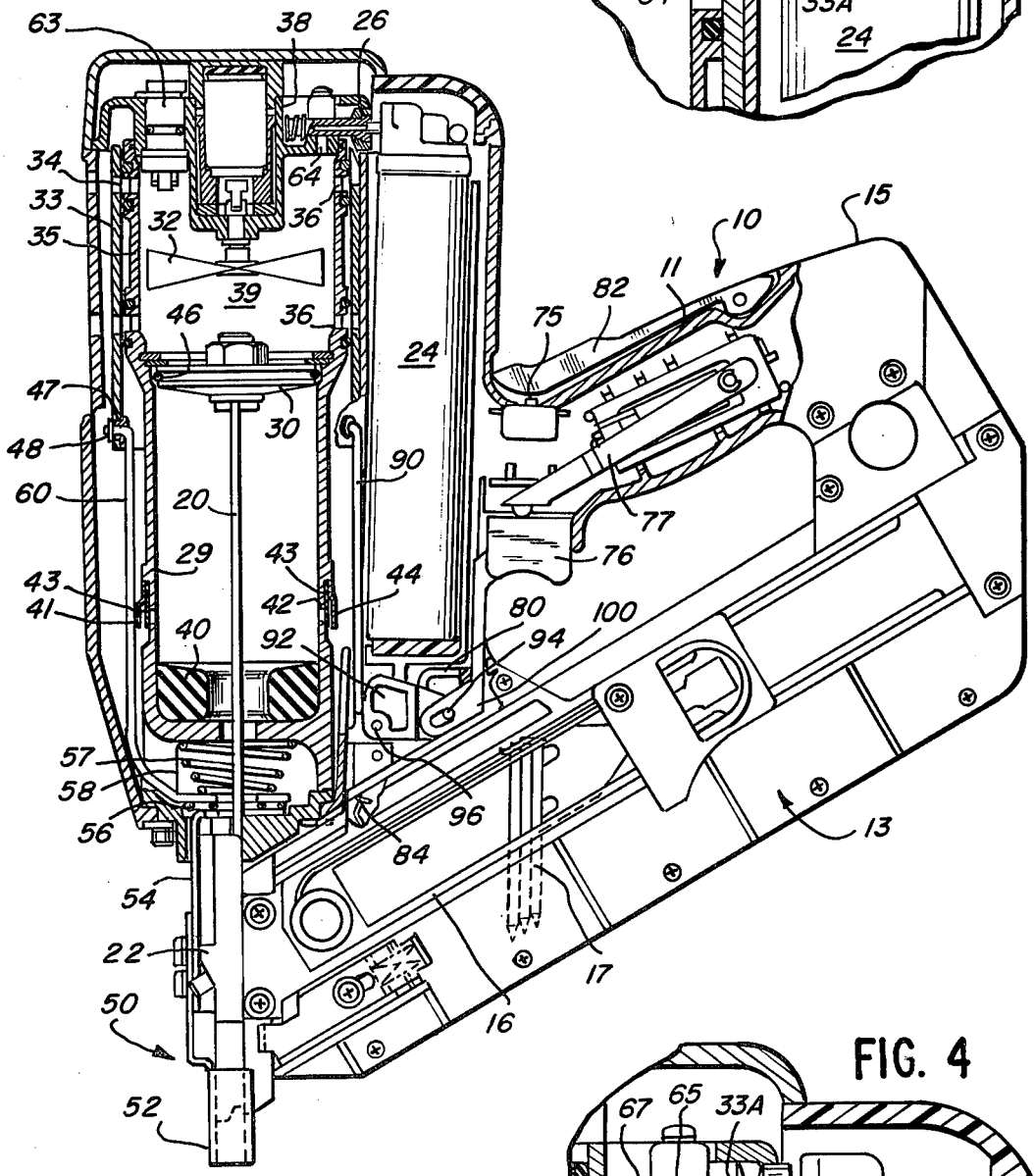
FIG. 1 is a partial cross-sectional, side elevational view of a fastener driving tool illustrating the relative position of the principal components prior to firing.

FIG. 1 illustrates a fastener driving tool 10 the principal components of which are attached to or carried by a generally hollow housing 11. The housing 11 of the tool 10 has three major sections: a barrel section 14; a graspable elongated handle section 15 extending horizontally outwardly from a position generally midway of the barrel section; and a base 13 extending under the barrel section and the handle section. Included in the base 13 is a magazine assembly 16 holding a row of nails 17 disposed transversely to the path of a fastener driver 20 and a battery pack (not shown) for the fan motor to be later discussed. The lower end of the barrel section 14 carries a guide assembly 22 which guides the fastener driver and associated fastener towards the workpiece. The magazine 16 supplies fasteners serially under the fastener driver 20 into the guide assembly 22 to be driven into the workpiece. The details of the magazine assembly are not important to an understanding of the present invention. The magazine assembly illustrated is described in detail in an application entitled "Magazine For Fastener Driving Tool", filed July 28, 1982 under Ser. No. 402,769.

A fuel tank 24 is mounted between the barrel section 14 and the handle section 15 of the housing 11. The fuel tank 24 is filled with a liquified combustible gas kept under pressure, such as MAPP gas, or propane or butane, which vaporizes when it is discharged to the combustion chamber. The upper end of the fuel tank 24 carries a fuel valve 26 for metering fuel out of the tank.

Located adjacent the valve 26 for controlling the opening and closing of the fuel valve is a valve actuator assembly 27, the operation of which will be described in detail hereinafter. Essentially, operation of the fuel valve assembly 26 introduces a metered amount of fuel into the combustion chamber. There is also provided a cap 28 which can be removed to replace the fuel tank 24.

At the interior of the lower end of the barrel section 14 of the housing 11 there is located the main cylinder 29 within which the driving piston 30 is mounted. The piston carries the upper end of the fastener driver 20. The upper end of the barrel section 14 of the housing 11 contains an electrically powered fan 32 for providing turbulence in the combustion chamber prior to ignition of fuel-air mixture disposed therein. The combustion chamber 39 within which the fan 32 is located is defined by the cylinder 35, cylinder head 38 and piston 30. The cylinder 35 in the illustrated embodiment is formed as an upper extension of cylinder 29 and defines ports 36 that are open or closed to atmosphere depending on the position of sleeve valve 33. As shown in FIG. 1 ports 34 of sleeve 33 are in alignment with ports 36 to admit air to combustion chamber 39 whereas in FIG. 2 where combustion has occurred the ports 34, 36 are out of alignment and the combustion chamber 39 has been sealed off from the atmosphere. The operation of the sleeve valve will be discussed hereinafter.

The lower end of the cylinder 29 is open to the atmosphere and has disposed therein an annular bumper 40 which serves as a shock absorber for the piston 30 at the bottom of its travel (see FIG. 5). Located above the lower end of the bumper 40 are a plurality of ports 42. The piston 30 moves between the upper end of the cylinder 29 and the lower end as shown in FIG. 5 carrying with it the fastener driver 20 which slidably moves through the guide assembly 22. As illustrated in the drawings, the piston is frictionally engaged with the sidewalls of the cylinder 29 by sealing means 46 comprising an o-ring disposed between the outside periphery of the piston 30 and the inside sidewalls of the main cylinder 29. The o-ring is sized so that the frictional force between the piston 30 and the inside sidewalls of the main cylinder 29 is sufficiently great that in the absence of a differential pressure across the piston, the piston will remain fixed in place relative to the interior sidewalls of the main cylinder. The relationship is required so that when the piston is returned to its driving position it will remain in this position until the tool is again fired. It is to be noted that when the tool is not being operated the piston 30 shown in FIG. 1 will move slightly downward to where the o-ring 46 will frictionally engage the inside sidewall of cylinder 29 and remain positioned in the driving position.

It is to be noted that the ports 42 are normally closed off from atmosphere by flap valves 43 which are supported in their open position by a ring 44. During the driving of the piston the air under the piston will be evacuated to atmosphere through the bottom of the cylinder 29 with the ports 42 remaining closed. After the system 30 passes the ports 42 the combustion gasses located above the piston will open to valves 43 to assist in the evacuating of the combustion gasses to help provide a vacuum in the expanded combustion chamber resulting from the downward movement of the piston 30. (see FIG. 5).

As previously mentioned the movement of the sleeve valve 33 that is slidably disposed relative to the cylinder 35 controls the opening and closing of the combustion chamber 39. When the sleeve 33 is in its upper position it closes off the combustion chamber 39 from atmosphere (see FIG. 2). When lowered as shown in FIG. 1 the sleeve 33 permits expunging of the combustion gases as well as the reintroduction of fresh air into the combustion chamber. It can be seen that in the position shown in FIG. 1 the combustion chamber is open to atmosphere both above and below the fan 32.

The movement of the sleeve valve 33 is affected by a work sensitive probe assembly 50 that functions to move the sleeve valve 33 to close the combustion chamber and permit operation of the tool in the manner to be described hereinafter when it is brought into contact with the workpiece into which a fastener is to be driven. In the embodiment illustrated the mechanism interconnecting the work sensitive probe sleeve 52 and link 54 to the sleeve 33 includes a member 56 biased outwardly by spring 57 in chamber 58. Connected to member 56 is a set of lifting rods 60 that are connected to the slidable sleeve 33 and when moved function to raise and lower the sleeve 33. Specifically, connected to the member 56 are four rods, the upper ends of which extend into through openings 47 in the sleeve 33 and are retained therein by rings 48. Thus, contact of the sleeve 52 with the workpiece will result in the combustion chamber being closed and will permit operation of the tool as described hereinafter.

All the major components fitting within the barrel section 14 of the housing 11 have been described with the exception of those components that are joined to the cylinder head 38.

The cylinder head 38 carries the electric fan 32, spark plug 63 and provides an internal passageway 64 through which fuel is injected into the combustion chamber 39.

Figure 3:
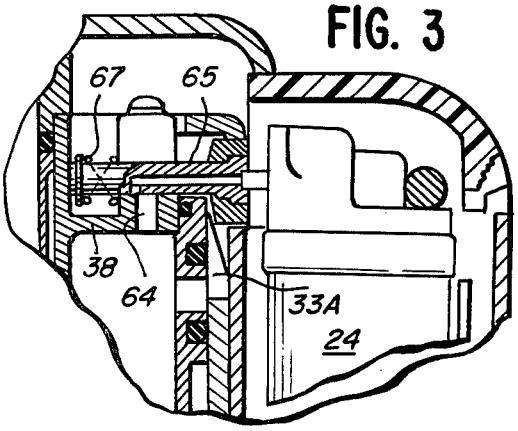
FIG. 3 is an enlarged view showing the metering valve in the closed position.
Figure 4:
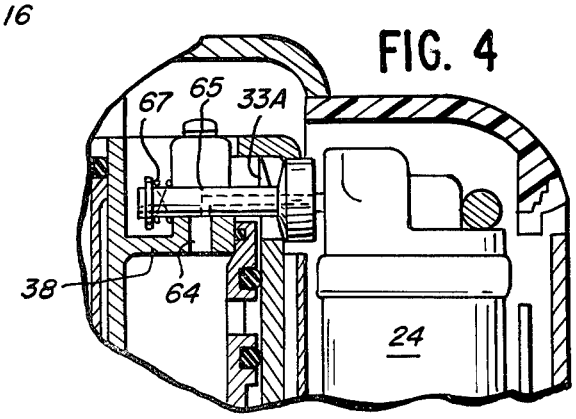
FIG. 4 is an enlarged view showing the metering valve opened by the upward movement of the valve sleeve.

Referring now to FIGS. 3 and 4 there is illustrated the mechanism for operating the fuel metering valve. It can be appreciated that the prescribed amount of fuel is to be introduced into the combustion chamber 39 after the chamber is filled with air and has been sealed off from the atmosphere. To this end, the control of the fuel valve 26 is effected by the movement of the sleeve valve 33. Specifically the fuel valve is opened to admit a quantity of fuel through the passageway 64 to the combustion chamber 39 by a wedge shaped portion 33A of the sleeve 33 which portion 33A biases the valve actuator 65 to the right against the action of the spring 67 located between the cylinder head 38 and a ring 66 secured to the actuator 65. This mode of operation occurs after the sleeve 33 has been moved upwardly an amount sufficient to seal the combustion chamber 39. (see FIG. 4).

Located in the handle 15 of the housing 11 are the controls for operating the tool 10. This includes a switch 75, a trigger mechanism 76, a piezo-electric firing circuit 77 which activates the spark plug 63 and a cam interlock mechanism 80 the operation of which controls the actuation of the trigger. The switch 75 is operated when the operator grips the handle of the tool and contacts the pivoted lever 82 which makes contact with the switch 75. The electrical contact assembly is joined in series with the battery pack located in the base of the magazine assembly and with the switch 84 connected to complementary portions of the magazine assembly 16 and the main housing 11. When the magazine is in spaced relation to the housing the fan circuit is broken and cannot be activated. Contact with the switch 75 actuates the electric fan so that it is turned on the moment the fastener tool is gripped.

As previously mentioned, the trigger cannot be operated until the cam interlock assembly 80 is free to move. Movement of the cam interlock assembly is normally prevented from being moved by a U-shaped trigger rod mechanism 90 (see FIG. 7) that is secured to the sleeve 33. As shown in FIG. 1 when the work sensitive probe assembly 50 is in the extended position the U-shaped rod 90 is located immediately adjacent the generally triangular shaped cam member 92. The trigger 76 is associated with a pin 94 extending from one end of the triangular cam 92 which cam is pivotally mounted relative to the housing by pivot 96. The pin 94 is located in an elongated slot 98 found in the trigger bracket 100 which facilitates upward movement of the trigger bracket while causing pivotal movement of the cam member 92. Thus as shown in FIG. 1 the trigger 76 cannot be moved upwardly to activate the piezo-electric system 77 until the U-shaped rod 90 located adjacent the cam 92 has been moved out of abutting relationship therewith. Disengagement of the rod 90 from cam 92 will occur upon upper movement of the sleeve 33 resulting from the upward movement of the work probe assembly resulting when it contacts a workpiece.

Referring to FIG. 2 it is shown that the slidable sleeve 33 has been moved to close off the combustion chamber in which position the U-shaped rod 90 has been moved free of the cam and thus the trigger can be moved upwardly to pivot the cam 92 about its pivot pin 96. During this motion the pin 94 secured to the cam which fits in the slot 98 of the trigger moves to the lower end of the slot 98 in the manner shown in FIG. 2. Thus it can be seen that the tool can be fired when the workpiece has been engaged and the trigger rod 90 is removed from adjacent the cam. It remains to note that the configuration of the cam 92 is such that the rod 90 cannot descend to permit opening of the combustion chamber by downward movement of the slidable cylinder if the trigger is not released due to the rod 90 being blocked by the adjacent upper surface 102 of the cam 92. Thus the trigger must be released to permit the slidable sleeve to move to open the combustion chamber to atmosphere. When the trigger is released to the biasing force extended there-against by the piezo-electric member the cam 92 is moved in a clockwise direction back to the position shown in FIG. 1 to where the sleeve 33 is free to move downwardly by the action of the spring 57 against the member 56. The rod 90 will then be lowered into the position shown in FIG. 1 with the result that the tool cannot be fired until the work sensitive probe assembly has been reenergized.

Tool Operation

Now that all the major components of the tool have been described in detail the integrated operation of the various components of the tool will be described while highlighting the remarkable manner in which the tool operates.

Referring to FIG. 1, whenever the tool 10 is grasped about its handle the switch 75 is tripped which starts the electric fan 32. It is to be noted that this will occur only if the magazine assembly is in its proper position relative to the housing so that the switch 84 which is in series with the switch 75 is closed. As long as the tool is held above the workpiece such that the link 54 is fully extended, the combustion chamber remains open to the surrounding atmosphere through suitable openings in the housing 14 due to the sleeve 33 being maintained in the combustion chamber open position by the biasing spring 57. Since the electric fan 32 is running a differential pressure is produced across the combustion chamber 39 and fresh air will be introduced into the combustion chamber. The rotating fan blades produces a turbulent effect within the combustion chamber 39.

Once the tool 10 is positioned in engagement with a workpiece the work sensitive probe assembly 50 is moved inwardly. This action overcomes the biasing spring 57 and forces the member 56 and associated lifting rods 60 upwardly which moves the sleeve 33 upwardly to close the combustion chamber. The upward movement of the sleeve 33 carries with it the rod 90 and thus moves it up out of contact with the cam 92 to permit the trigger 76 to be fired. It is to be noted that as the sleeve 33 is moved upwardly it engages the valve actuator 65 to open the fuel valve 26 to introduce a metered amount of fuel into the combustion chamber. Movement of the trigger button 76 which is now possible since the rod 90 has been moved out of position trips the piezo-electric firing circuit 77 which fires the spark plug in the combustion chamber. The explosive gases moves the piston 30 downwardly to drive a fastener into the workpiece. The piston moves downwardly to its driven position past the ports 42 and engages the bumper 40. During the piston travel the air under the piston is forced outwardly through the open bottom of the cylinder 29. When the piston passes the ports 42 the combustion gasses above the piston flow out through ports 42. This venting assists in creating a partial vacuum in the combustion chamber. This all occurs very quickly and the partial vacuum is not instantly relieved since even though the tool may be immediately removed from the workpiece the trigger has not been released and the sleeve valve 33 cannot move down to open the combustion chamber. The partial vacuum combined with the atmospheric air under the piston acts to return the driven piston back to its driving position. When the piston is returned to the driving position it is retained in frictional contact with the upper portion of the cylinder. This all happens very quickly and thus will occur before the trigger is released. When the trigger is released it is biased outwardly by the force exerted through the piezo-electric system 77. Movement of the trigger rotates the cam 92 in a clockwise direction to the position shown in FIG. 1 at which time the sleeve valve 33 will be free to move downwardly through the action of spring 57 to open the combustion chamber to atmosphere to permit scavenging of the combustion chamber through the action of the fan.

It is intended to cover by the appendant claims all such modifications which fall within the true spirit and scope of the invention. For example, while a sleeve valve has been illustrated as a means for controlling the opening and closing of the combustion chamber other slidable members actuated by the work sensitive probe assembly could be employed.

What is claimed is:

1. A portable fastener driving tool comprising a housing, a main cylinder in said housing, a piston in said main cylinder and movable from a driving to a driven position, a driver attached to said piston, a magazine for supplying fasteners into position to be driven by said driver, a combustion chamber within said housing having a wall portion defining a plurality of openings and said piston as a wall portion thereof, a fan in said combustion chamber and controls therefor to operate same to cause turbulence in said chamber, means for controlling the flow of gases into and out of said combustion chamber, a work sensitive probe assembly cooperating with said means for controlling the flow of gases whereby the combustion chamber is not closed off until the tool is in position to drive a fastener into a workpiece, means for providing fuel into said combustion chamber and igniting same for driving said piston to drive a fastener and trigger operated means responsive to movement of said means for controlling the flow of gases into and out of said combustion chamber whereby the tool cannot be fired until the combustion chamber is closed and the chamber cannot be opened until the trigger is released, and the improvement wherein the wall portion of the combustion chamber is fixed relative to the housing and said means for controlling the flow of gases includes a slidable member disposed adjacent said openings, movable relative to said combustion chamber, and secured to said probe assembly.

2. A portable fastener driving tool as set forth in claim 1 in which the combustion chamber wall portion defining said openings is cylindrical and the slidable member for controlling the flow through said openings is a sleeve member surrounding said cylindrical wall portion that defines openings adapted to be out of alignment with said combustion chamber openings when the tool is in engagement with the workpiece and to open said combustion chamber to atmosphere when the tool is removed from the workpiece.

3. A portable fastener tool as set forth in claim 2 in which the means for providing fuel to the combustion chamber includes a metering valve controlled by a valve actuator and the sleeve member defines a portion adapted to engage said valve actuator to open said metering valve to admit fuel to the combustion chamber when the combustion chamber has been closed off from the atmosphere.

4. A portable tool as set forth in claim 2 in which the bottom of the main cylinder is open to atmosphere and has disposed adjacent the bottom thereof a bumper for damping the action of the piston at the end of its driving stroke, said main cylinder also defining a plurality of valved openings adjacent said bumper whereby when the driving piston passes said openings the combustion gases will flow out through said valved openings to vent the combustion gases and thus facilitate the return of the piston to its driving position resulting from the differential pressure between the atmospheric pressure below the piston and the partial vacuum occurring in the combustion chamber after combustion occurs.

* * * * *